US009772587B2

(12) United States Patent
Iwasaki et al.

(10) Patent No.: US 9,772,587 B2
(45) Date of Patent: Sep. 26, 2017

(54) HEATER AND IMAGE HEATING APPARATUS

(71) Applicant: CANON KABUSHIKI KAISHA, Tokyo (JP)

(72) Inventors: Atsushi Iwasaki, Susono (JP); Keisuke Mochizuki, Suntou-gun (JP); Masato Sako, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/262,418

(22) Filed: Sep. 12, 2016

(65) Prior Publication Data

US 2017/0075269 A1 Mar. 16, 2017

(30) Foreign Application Priority Data

Sep. 14, 2015 (JP) ..... 2015-181134

(51) Int. Cl.
*G03G 15/20* (2006.01)
*H05B 3/03* (2006.01)
*H05B 3/10* (2006.01)

(52) U.S. Cl.
CPC ..... *G03G 15/2053* (2013.01); *G03G 15/2014* (2013.01); *G03G 15/2042* (2013.01); *G03G 2215/2035* (2013.01)

(58) Field of Classification Search
None
See application file for complete search history.

(56) References Cited

U.S. PATENT DOCUMENTS 8,471,178 B2 * 6/2013 Taniguchi ..... G03G 15/2042 219/216
8,552,342 B2 * 10/2013 Sakakibara ..... H05B 3/0095 219/216
8,592,726 B2 * 11/2013 Tsuruya ..... G03G 15/2042 219/216
9,095,003 B2 * 7/2015 Sakakibara ..... H05B 3/0095
9,098,035 B2 * 8/2015 Nakahara ..... G03G 15/2053
9,235,166 B2 1/2016 Shimura
9,445,457 B2 * 9/2016 Sakakibara ..... H05B 3/0095
(Continued)

FOREIGN PATENT DOCUMENTS

JP H0985275 A 7/1997
JP 2000206811 A 7/2000
(Continued)

*Primary Examiner* — Joseph M Pelham
(74) *Attorney, Agent, or Firm* — Rossi, Kimms & McDowell LLP

(57) ABSTRACT

The heater to be used for an image heating apparatus includes a substrate, and first and second heat generation lines that are provided on the substrate along a longitudinal direction of the substrate, and are each divided into a plurality of heat generation blocks that can be mutually independently controlled, in the longitudinal direction, wherein in the plurality of heat generation blocks in the second heat generation line, a heat generation block is provided that overlaps one heat generation block in the first heat generation line in the longitudinal direction, and has a different heat generation distribution in the longitudinal direction, and can be independently controlled. Accordingly, the heater can form a heat generation distribution that is suitable for various paper sizes.

18 Claims, 10 Drawing Sheets

(56) References Cited

U.S. PATENT DOCUMENTS 9,494,899 B2 * 11/2016 Nakahara ..... G03G 15/2053
2011/0062140 A1 * 3/2011 Sakakibara ..... H05B 3/0095 219/216
2012/0121306 A1 * 5/2012 Shimura ..... H05B 3/0095 399/329
2012/0201581 A1 * 8/2012 Shimura ..... G03G 15/2082 399/329
2012/0201582 A1 * 8/2012 Shimura ..... H05B 3/0095 399/329
2012/0308280 A1 * 12/2012 Tsuruya ..... G03G 15/2042 399/329
2013/0251428 A1 * 9/2013 Ueno ..... H05B 3/12 399/333
2013/0299480 A1 * 11/2013 Kakubari ..... G03G 15/2053 219/216
2013/0343790 A1 * 12/2013 Shimura ..... G03G 15/2053 399/329
2013/0343791 A1 * 12/2013 Shimura ..... G03G 15/2053 399/329
2014/0003848 A1 * 1/2014 Sakakibara ..... H05B 3/0095 399/335
2014/0076878 A1 * 3/2014 Shimura ..... G03G 15/2042 219/216
2014/0169845 A1 * 6/2014 Nakahara ..... G03G 15/2053 399/328
2015/0289317 A1 * 10/2015 Sakakibara ..... H05B 3/0095 399/329
2015/0293483 A1 * 10/2015 Nakahara ..... G03G 15/2053 399/333

FOREIGN PATENT DOCUMENTS

JP 2003029559 A 1/2003
JP 2010054846 A 3/2010
JP 2014059508 A 4/2014

* cited by examiner

HEATER AND IMAGE HEATING APPARATUS

BACKGROUND OF THE INVENTION

Field of the Invention

The present invention relates to an image heating apparatus of a fuser that is mounted on an image forming apparatus such as a copying machine using an electrophotographic method and an electrostatic recording method, and a printer; a glossiness imparting apparatus that heats a fixed toner image on a recording material again and thereby enhances glossiness of the toner image; and the like. In addition, the present invention relates to a heater which is used in the image heating apparatus.

Description of the Related Art

As for the image heating apparatus, there is an apparatus that has a cylindrical film, a heater which comes in contact with an inner surface of the film, and a roller which forms a nipping portion together with the heater through the film. When an image forming apparatus that mounts the image heating apparatus thereon continuously prints small-sized sheets of paper, such a phenomenon (temperature rise in paper non-passing part) occurs that a temperature in a region gradually increases in which the paper does not pass in a longitudinal direction of the nipping portion. When the temperature on the paper non-passing part becomes excessively high, the high temperature occasionally gives damage to each part in the apparatus, and when the image forming apparatus prints large-sized sheets of paper in a state in which the temperature has risen in the paper non-passing part, a toner is occasionally offset onto the film at high temperature in a region corresponding to a paper non-passing part in the small-sized paper.

As one method for suppressing the temperature rise in the paper non-passing part, Japanese Patent Application Laid-Open No. 2014-59508 discloses an apparatus that divides a heat generating resistor on the heater into a plurality of groups (heat generation blocks) in a longitudinal direction of the heater, and changes a heat generation distribution of the heater according to the size of a recording material.

Because the recording materials which are used in the apparatus have many sizes, a heater is desired that can form the heat generation distribution which is more suitable for various sizes.

SUMMARY OF THE INVENTION

An object of the present invention is to provide a heater which can form a heat generation distribution that is suitable for various paper sizes; and an image heating apparatus.

Another object of the present invention is to provide a heater including a substrate, a first heat generation line configured to be provided on the substrate along a longitudinal direction of the substrate, and is divided into a plurality of heat generation blocks which is mutually independently controllable, in the longitudinal direction, and a second heat generation configured to be provided on the substrate along the longitudinal direction of the substrate, and is divided into a plurality of heat generation blocks which is mutually independently controllable, in the longitudinal direction, wherein in the plurality of heat generation blocks in the second heat generation line, a heat generation block is provided that overlaps one heat generation block in the first heat generation line in the longitudinal direction, has a different heat generation distribution in the longitudinal direction, and is independently controllable.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The mode for carrying out the present invention will be illustratively described in detail below, based on embodiments, with reference to the drawings. However, the dimensions, materials, shapes, the relative arrangements and the like of the components which are described in the following embodiments should be appropriately changed according to the structure of an apparatus to which the present invention is applied, and to various conditions. In other words, the mode is not intended to limit the scope of the present invention to the following embodiments.

Embodiment 1

1. Structure of Image Forming Apparatus

Figure 1:
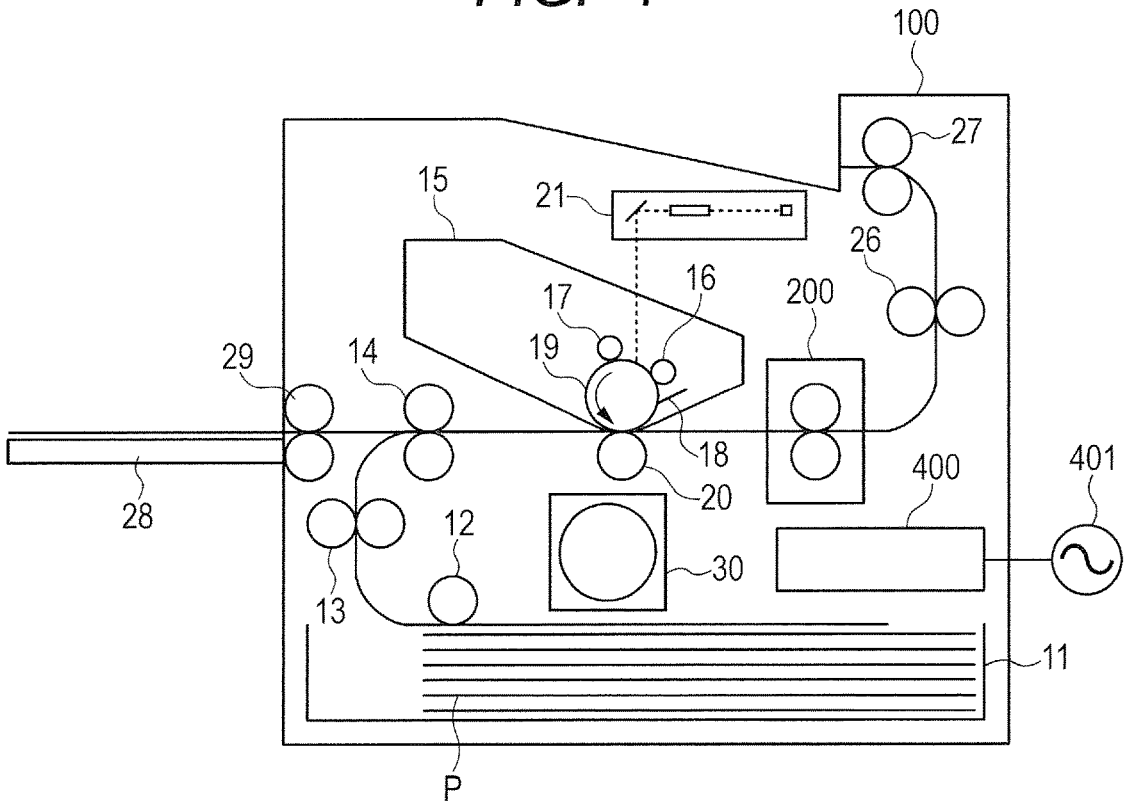
FIG. 1 is a cross-sectional view of an image forming apparatus.

FIG. 1 is a schematic cross-sectional view of an image forming apparatus according to an embodiment of the present invention. The image forming apparatus 100 in the present embodiment is a laser printer that forms an image on a recording material by using an electrophotographic system. When a print signal is generated, a scanner unit 21 emits a laser beam which has been modulated according to image information, and scans the surface of a photosensitive drum 19 which has been charged to a predetermined polarity by a charging roller 16. Thereby, an electrostatic latent image is formed on the photosensitive drum 19. A toner is supplied to this electrostatic latent image from a developing roller 17, and thereby the electrostatic latent image on the photosensitive drum 19 is developed as a toner image (image by toner). On the other hand, the recording materials (recording paper) P which have been loaded in a paper-feeding cassette 11 are fed one by one by a pickup roller 12, and are conveyed toward a pair of resist rollers 14 by a pair of conveyance rollers 13. Furthermore, the recording material P is conveyed to a transfer point from the pair of resist rollers 14 so as to match the time when the toner image on the photosensitive drum 19 reaches the transfer point which is formed by the photosensitive drum 19 and the transfer roller 20. The toner image on the photosensitive drum 19 is transferred onto the recording material P in a process in which the recording material P passes through the transfer point. After that, the recording material P is heated by a fixing apparatus (image heating apparatus) 200, and the toner image is fixed on the recording material P by heat. The recording material P which carries a fixed toner image thereon is ejected onto a tray in the upper part of the image forming apparatus 100, by a pair of conveyance rollers 26 and 27.

Incidentally, a drum cleaner 18 cleans the photosensitive drum 19, and a paper-feeding tray 28 (manual paper-feeding tray) has a pair of recording material restriction plates of which the width is adjustable according to the size of the recording material P. The paper-feeding tray 28 is provided so as to cope also with the recording materials P having the sizes other than the standard size. A pickup roller 29 feeds the sheets of the recording material P from the paper-feeding tray 28, and a motor 30 drives a roller 208 in the fixing apparatus, and the like. The heater 300 in the fixing apparatus 200 is energized by a commercial AC power supply 401 through a control circuit 400 which is connected to the power source. The above described photosensitive drum 19, the charging roller 16, the scanner unit 21, the developing roller 17 and the transfer roller 20 constitute an image forming section which forms an unfixed image on the recording material P. In addition, in the present embodiment, the photosensitive drum 19, the charging roller 16, a developing unit including the developing roller 17, and a cleaning unit including the drum cleaner 18 are structured as a process cartridge 15 so as to be attachable to and removable from the main body of the image forming apparatus 100.

The image forming apparatus 100 in the present embodiment copes with the plurality of sizes of the recording materials. In the paper-feeding cassette 11, a letter sheet (215.9 mm×279.4 mm), a legal sheet (215.9 mm×355.6 mm), an A4 sheet (210 mm×297 mm) and a 16 k sheet (195 mm×270 mm) can be set. Furthermore, an executive sheet (184.2 mm×266.7 mm), a JIS B5 sheet (182 mm×257 mm), a JIS A5 sheet (148 mm×210 mm) and the like also can be set. In addition, a sheet not having regular sizes, which includes an index card of 3 inches×5 inches (76.2 mm×127 mm), a DL envelope (110 mm×220 mm) and a C5 envelope (162 mm×229 mm), can be fed from the paper-feeding tray 28, and can be printed.

The image forming apparatus 100 in the present embodiment basically longitudinally feeds sheets of paper (conveys sheets of paper so that long side becomes parallel to conveyance direction). In the image forming apparatus 100 of the present embodiment, the maximum paper-passing width of the recording material P is 215.9 mm, and the minimum paper-passing width is 76.2 mm. Incidentally, the printer in the present embodiment is an image forming apparatus of the center reference, which conveys the recording material so as to match the center in the width direction of the recording material with a conveyance reference X that is set at the center in the longitudinal direction of the heater.

2. Structure of Fixing Apparatus

Figure 2:
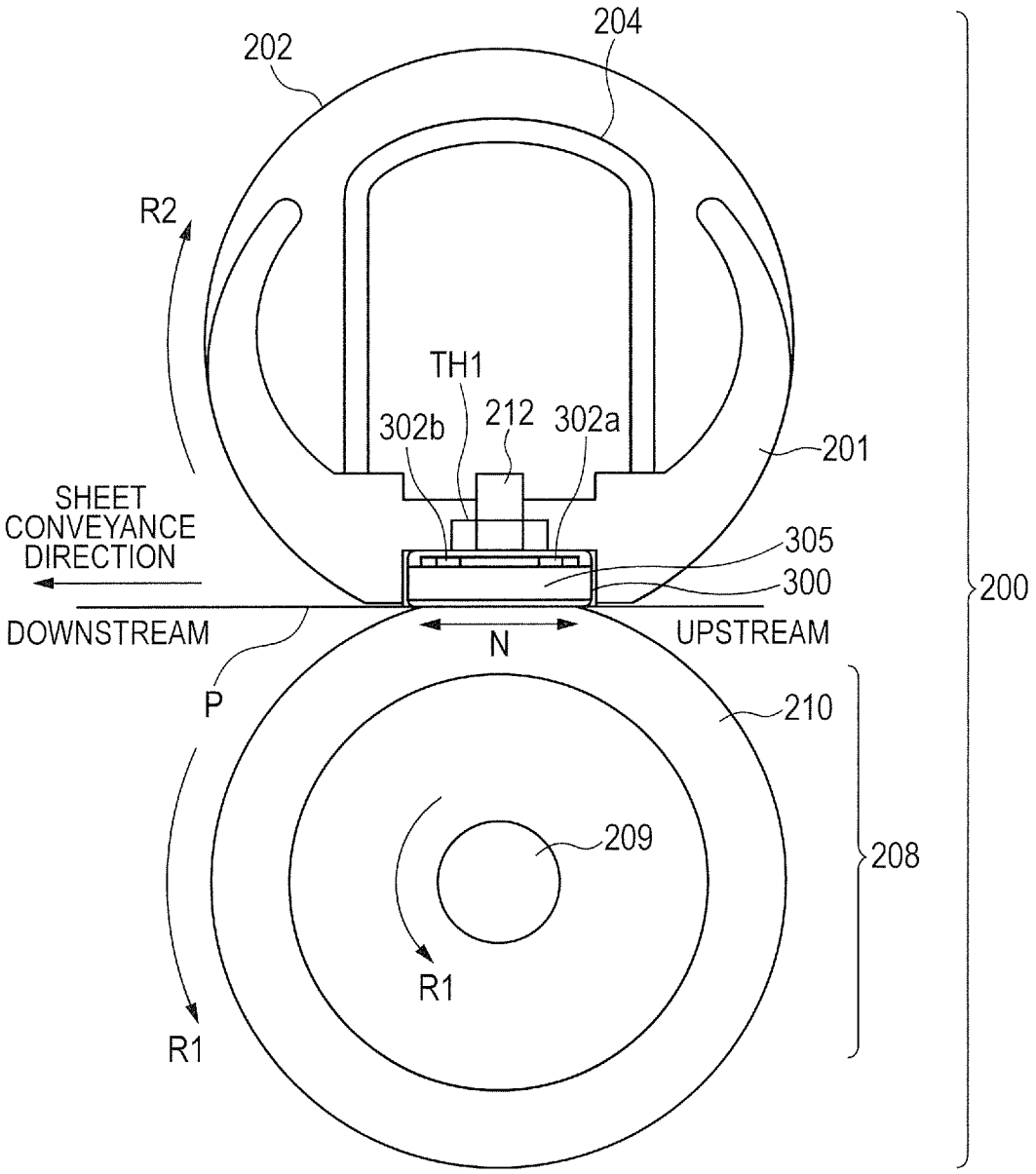
FIG. 2 is a cross-sectional view of the image heating apparatus in Embodiment 1.

FIG. 2 is a cross-sectional view of a fixing apparatus 200 of the present embodiment. The fixing apparatus 200 has: a cylindrical fixing film 202; a heater 300 that comes in contact with the inner surface of the fixing film 202; a pressure roller 208 that forms a fixing nip portion N together with the heater 300 through the fixing film 202; and a metal stay 204. The fixing film 202 is a double layer heat-resistant film which is formed into a cylindrical shape, and uses a heat-resistant resin such as polyimide or a metal such as stainless, as a base layer. In addition, the surface of the fixing film 202 is covered with a heat-resistant resin such as a tetrafluoroethylene-perfluoroalkyl vinyl ether copolymer (PFA) that is excellent in releasing properties, and has a releasing layer formed thereon, so as to prevent the deposition of the toner and secure separability from the recording material P. The pressure roller 208 has a cored bar 209 which is formed from a material such as iron or aluminum, and has an elastic layer 210 which is formed from a material such as silicone rubber. The heater 300 is held by a heater holding member 201 made from a heat-resistant resin, and heats the fixing film 202. The heater holding member 201 has also a guiding function for guiding the rotation of the fixing film 202. The metal stay 204 receives an unillustrated pressure force, and pushes the heater holding member 201 toward the pressure roller 208.

The pressure roller 208 receives a motive power from a motor 30, and rotates in a direction of the arrow R1. When the pressure roller 208 rotates, the fixing film 202 thereby rotates in a direction of the arrow R2 so as to follow the rotation of the pressure roller 208. The pressure roller 208 gives heat of the fixing film 202 to the recording material P while sandwiching and conveying the recording material P in the fixing nip portion N, and thereby subjects the unfixed toner image on the recording material P to fixing treatment. Thermistors TH1, TH2, TH3 and TH4 abut on the heater 300, which are one example of a temperature detecting member. Energization of the heater 300 is controlled based on the output of the thermistor TH1 which is provided within the minimum paper-passing width (76.2 mm in the present embodiment) among the paper passing references for the recording material P. In addition, a safety element 212 such as a thermoswitch, a temperature fuse and the like which operate due to an abnormal heat generation of the heater 300 and interrupts the energization to the heater 300 also abut on the heater 300.

3. Structure of Heater

Figure 3A:
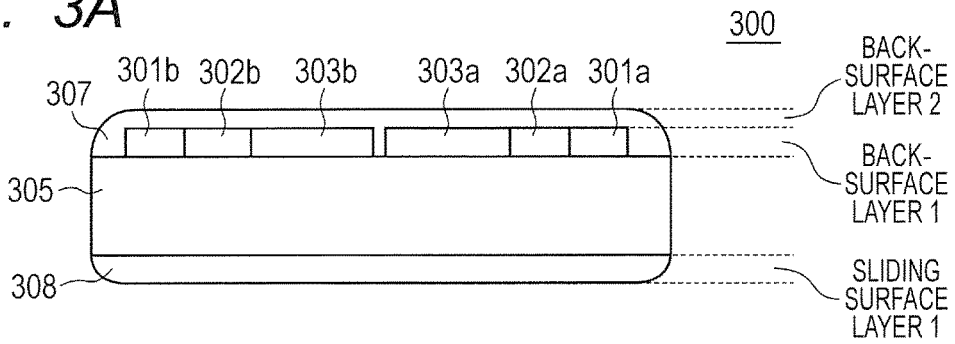
FIGS. 3A, 3B and 3C are block diagrams of heaters in Embodiment 1.
Figure 3B:
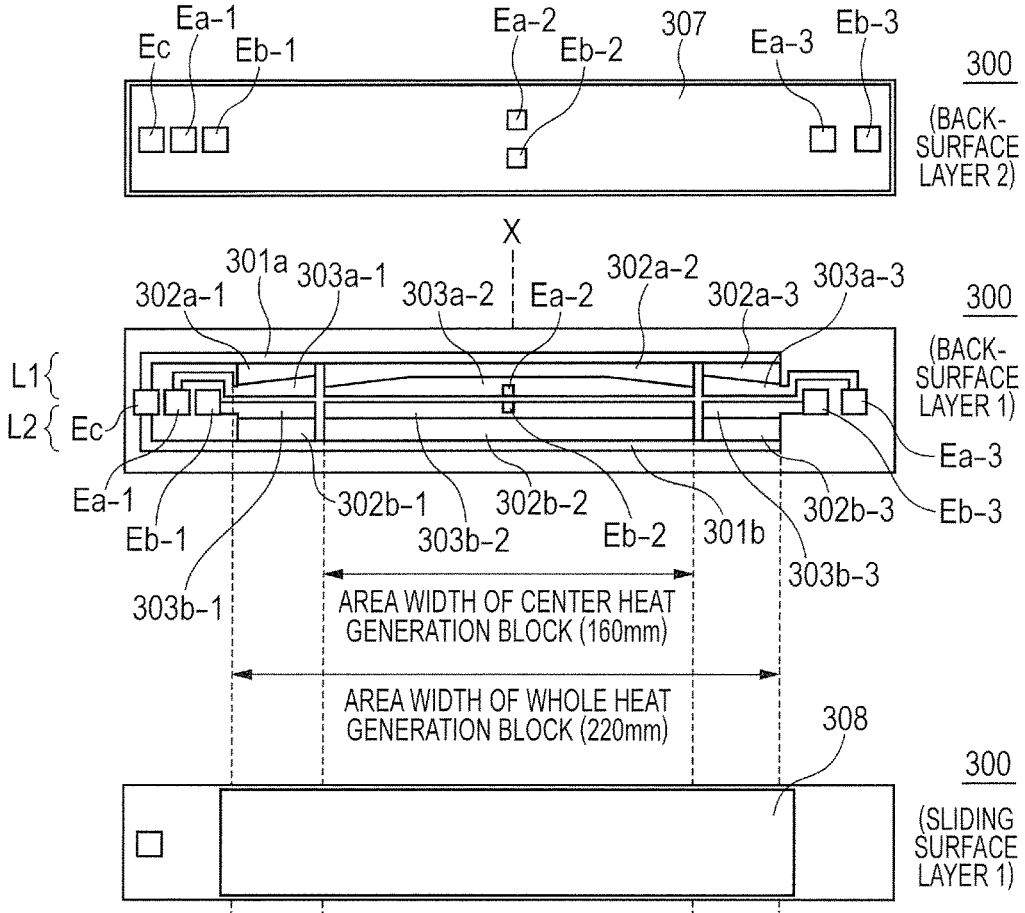
Figure 3C:
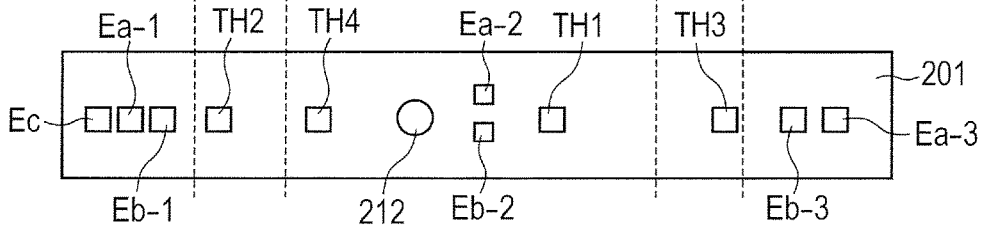

FIG. 3A to FIG. 3C are views illustrating a structure of the heater 300 according to the present embodiment. FIG. 3A is a cross-sectional view of the heater. FIG. 3B is a plan view of each layer of the heater. FIG. 3C is an arrangement view of the thermistor and the safety element in the holding member of the heater.

The heater 300 has a substrate 305 made from ceramic, and heat generation members 302*a* and 302*b* which are provided on the substrate 305. The heat generation member 302*a* and the heat generation member 302*b* have a different heat generation distribution from each other in the longitudinal direction of the heater, and are structured so that each energization can be independently controlled.

A first heat generation line L1 having the heat generation member 302*a* is divided into three heat generation blocks in the longitudinal direction of the heater, and is structured so as to be capable of independently controlling each of the heat generation blocks. Each of the heat generation blocks of the heat generation member 302*a* is structured so that a heating value per unit length is largest at a position which has a small distance from the paper passing reference X of the recording material P and is closer to the center in the longitudinal direction, and so that a heating value decreases as the distance from the center in the longitudinal direction increases.

A second heat generation line L2 having the heat generation member 302*b* is also similarly divided into three heat generation blocks in the longitudinal direction of the heater, and is structured so as to be capable of independently selecting and heating each of the heat generation blocks. Each of the heat generation blocks of the heat generation member 302*b* is structured so as to have the same heating value per unit length throughout the longitudinal direction as the others.

The heat generation blocks in the heat generation member 302*a* and the heat generation member 302*b* have each different heat generation distributions from the others in the longitudinal direction of the heater, and the heater 300 is structured so as to be capable of changing the heat generation distribution in the longitudinal direction by switching between combinations of connections among each of the heat generation blocks.

The heater 300 includes: a substrate 305 made from a ceramic; a sliding surface layer 1 that is a surface which comes in contact with the film 202; and a back-surface layer 1 having a heat generation member and a conductive member provided thereon, and a back-surface layer 2 that covers the back-surface layer 1, which will be described later. The sliding surface layer 1 is formed of a surface protective layer 308 which is formed of a coating made from glass, polyimide or the like. The back-surface layer 2 is formed of an insulating surface protective layer 307 (glass in the present embodiment).

The back-surface layer 1 which is provided on the substrate 305 has a conductive member 301*a* and a conductive member 301*b* that act as a conductive member A which is provided along the longitudinal direction of the heater 300. The conductive member 301*a* is arranged in the upstream side in the conveyance direction of the recording material P, and the conductive member 301*b* is arranged in the downstream side in the conveyance direction of the recording material P. In addition, the back-surface layer 1 has a conductive member 303*a* (303*a*-1 to 303*a*-3) and a conductive member 303*b* (303*b*-1 to 303*b*-3) which act as a conductive member B that is provided in parallel with the conductive member 301. The conductive member B is provided along the longitudinal direction of the heater 300 at a position different from that of the conductive member A in a transverse direction of the heater 300 (direction intersecting with (perpendicular to) longitudinal direction of heater).

Furthermore, the back-surface layer 1 has two types of heat generation blocks formed thereon. One is a group of heat generation blocks 302*a*-1 to 302*a*-3 that constitute the heat generation block which has the heat generation member 302*a* provided between the conductive member 301*a* and the conductive member 303*a* which form a pair of conductive members, and constitute a first heat generation block group (first heat generation line L1). The other is a group of heat generation blocks 302*b*-1 to 302*b*-3 that constitute the heat generation block which has the heat generation member 302*b* provided between the conductive member 301*b* and the conductive member 303*b* which form a pair of conductive members, and constitute a second heat generation block group (second heat generation line L2). The heat generation member 302*a* is arranged in the upstream side in the conveyance direction of the recording material P, and the heat generation member 302*b* is arranged in the downstream side in the conveyance direction of the recording material P. Both of the heat generation members 302*a* and 302*b* have positive temperature characteristics of resistance. The positive temperature characteristics of resistance are characteristics in which the resistance increases when the temperature rises.

The heat generation blocks 302*a*-1 to 302*a*-3 that constitute the first heat generation line L1 generate heat by being energized through the respective conductive members 303*a*-1 to 303*a*-3 which are connected to electrodes Ea-1 to Ea-3, and the conductive member 301*a* which is connected to an electrode Ec. In the present embodiment, in the heat generation blocks 302*a*-1 to 302*a*-3, resistance value distributions in the heat generation blocks are adjusted so that the heating value becomes largest in a region closer to the conveyance reference X and decreases as the distance from the conveyance resistance X increases in each of the heat generation blocks. In order to form such a resistance value distribution, the width of the heat generation member 302*a* in the transverse direction of the heater at the position which is closer to the reference X in each of the heat generation blocks is narrowly formed (so that resistance value between conductive member 301*a* and conductive member 303*a* becomes small). In addition, as the distance from the reference X increases, the width of the heat generation member 302*a* is widely formed (so that resistance value between conductive member 301*a* and conductive member 303*a* becomes large). A method for adjusting the resistance value distribution is not limited to the method, but the resistance value distribution can be similarly adjusted by an operation of adjusting the volume of the heat generation member, which includes changing the thickness of the heat generation member in the longitudinal direction.

In the present embodiment, the heating values in the heat generation block 302*a*-1 and the heat generation block 302*a*-3 which are the end portions in the longitudinal direction of the heater have been each adjusted so that when the heating value at the position which is closest to the reference X is specified as 100, the heating value at the position which is most distant from the reference X becomes 80, in each of the heat generation blocks. In these heat generation blocks, the resistance value distributions have been adjusted so that the heating value gradually decreases as the position becomes closer to the end portion from the reference X.

In addition, the heating value in the heat generation block 302*a*-2 in the middle has been adjusted so that when the heating value at the position of the reference X is specified as 100, the heating value in a space between the position of the reference X and a position 40 mm distant from the reference X becomes 100, and the heating value at the position which is the extreme end portion of the heat generation block 302*a*-2 becomes 80. Specifically, in the heat generation block 302*a*-2, there is a region of 80 mm, in which the heating value is flat, in the middle of the block in the longitudinal direction, and the resistance value distribution has been adjusted so that the heating value gradually decreases as the position becomes close to the end portion from the region.

Thus, in the plurality of heat generation blocks in the second heat generation line L2, a heat generation block is provided that overlaps one heat generation block in the first heat generation line L1 in the longitudinal direction of the substrate, has a different heat generation distribution in the longitudinal direction of the substrate, and can be independently controlled. In other words, in the first heat generation line L1 and the second heat generation line L2, there are heat generation blocks that have such a relationship that the heat generation blocks overlap each other in the longitudinal direction, have the different heat generation distributions from each other in the longitudinal direction, and can be independently controlled. For instance, the heat generation block 302*a*-2 in the first heat generation line L1 and the heat generation block 302*b*-2 in the second heat generation line L2 have such a relationship. In the heater in the present example, all of the three heat generation blocks in the first heat generation line L1, and all of the three heat generation blocks in the second heat generation line L2 satisfy the above described relationship.

The heat generation blocks 302*b*-1 to 302*b*-3 that constitute the second heat generation line L2 generate heat by being energized through the respective conductive members 303*b*-1 to 303*b*-3 which are connected to the electrodes Eb-1 to Eb-3, and the conductive member 301*b* which is connected to the electrode Ec. The heat generation blocks 302*b*-1 to 302*b*-3 have been formed so that the width of the heat generation member 302*b* in the transverse direction of the heater becomes uniform over the longitudinal direction of the heater in each of the heat generation blocks, in order to make the heating value per unit length fixed throughout the longitudinal direction.

In the present embodiment, the range in the longitudinal direction has been set at 220 mm (which corresponds to letter width), in which the heat generation blocks 302*a*-1 to 302*a*-3 that act as the first heat generation block group and the heat generation blocks 302*b*-1 to 302*b*-3 that act as the second heat generation block group are formed. Among the heat generation blocks, the range in which the heat generation block 302*a*-2 and the heat generation block 302*b*-2 that are positioned in the middle in the longitudinal direction are formed has been set at 160 mm (which corresponds to A5 width).

As is illustrated in FIG. 3C, in a holding member 201 of the heater 300, holes are provided for electric contact points of: the thermistors (temperature detecting element) TH1 to TH4; the safe element 212; and the electrodes Ea-1 to Ea-3, Eb-1 to Eb-3, and Ec. The above described electric contact points of the thermistors (temperature detecting element) TH1 to TH4, the safe element 212, and the electrodes Ea-1 to Ea-3, Eb-1 to Eb-3, and Ec are provided between a stay 204 and the holding member 201, and abut on the back surface of the heater 300. The electric contact points of the electrodes Ea-1 to Ea-3, Eb-1 to Eb-3, and Ec are electrically conducted to the electrode portions, respectively, by a contact pressure, welding or the like. In addition, the electric contact points are connected to a heater control circuit 400 which will be described later, through a conductive material such as a cable or a thin metal plate, which has been provided between the stay 204 and the holding member 201.

4. Configuration of Heater Control Circuit

Figure 4:
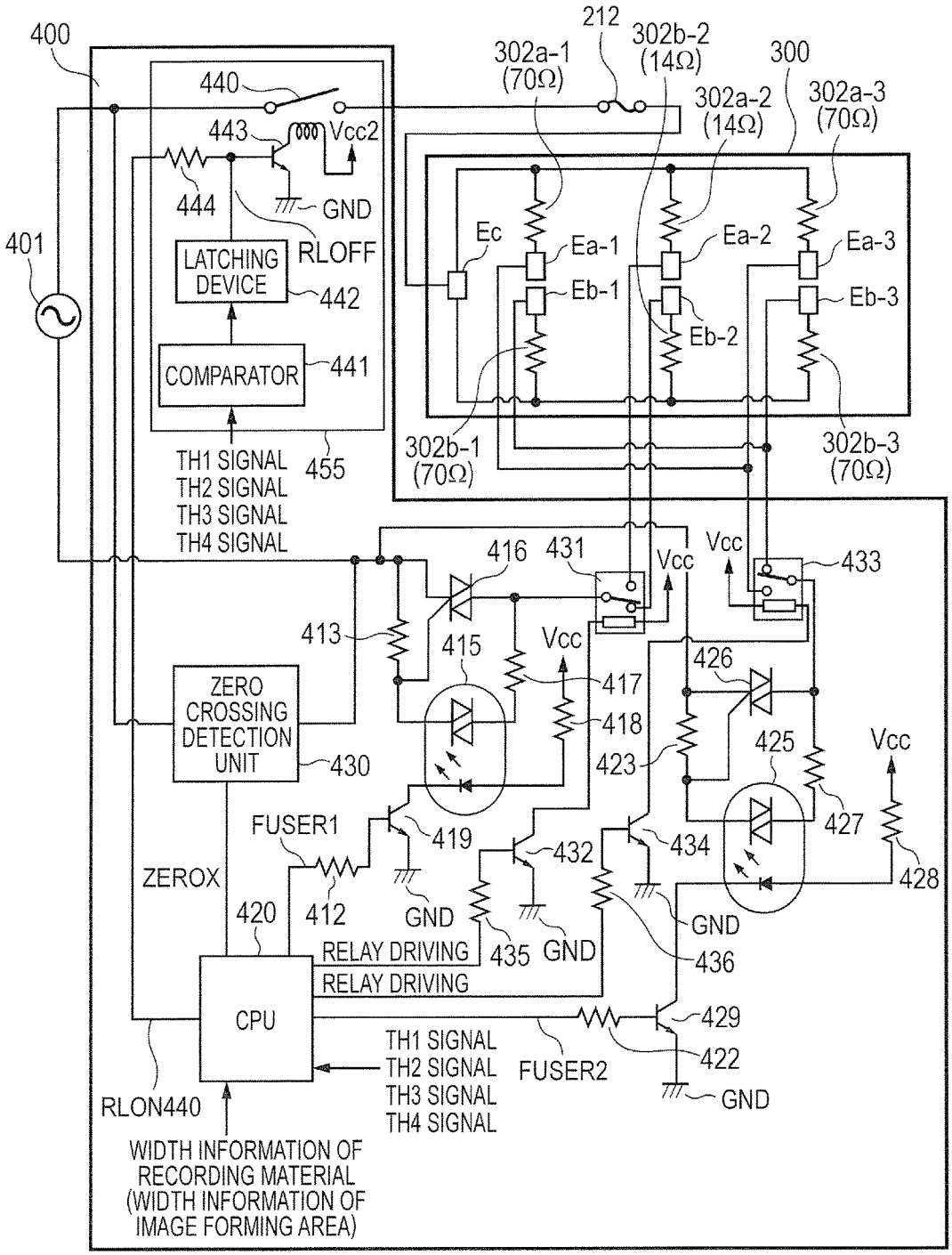
FIG. 4 is a diagram of a heater control circuit in Embodiment 1.

FIG. 4 is a circuit diagram of a heater control circuit 400 in the present embodiment. A commercial AC power supply 401 is connected to the image forming apparatus 100. Energization of the heater 300 is controlled by the energization/interruption of a triac 416 and a triac 426. A two-pole type switching relay 431 is arranged on a conducting wire of the triac 416, and according to the state, energizes and makes any one of the heat generation block 302*a*-2 and the heat generation block 302*b*-2 generate heat, as the center heat generation block. In addition, a two-pole type switching relay 433 is arranged on a conducting wire of the triac 426, and according to the state, energizes and makes any one of the heat generation blocks 302*a*-1 and 302*a*-3 or any one of the heat generation blocks 302*b*-1 and 302*b*-3 generate heat, as the end heat generation block.

In addition, the triac 416 and the triac 426 are independently controlled, and thereby for instance, the heat generation blocks 302*b*-1 and 302*b*-3 and the heat generation block 302*b*-2 are independently controlled. The heater 300 is energized through the electrodes Ea-1 to Ea-3 or the electrodes Eb-1 to Eb-3, and the electrode Ec. In the present embodiment, the resistance values of the heat generation blocks 302*a*-1 and 302*b*-1 have been set at 70Ω, the resistance values of the heat generation blocks 302*a*-2 and 302*b*-2 have been set at 14Ω, and the resistance values of the heat generation blocks 302*a*-3 and 302*b*-3 have been set at 70Ω.

A zero crossing detection unit 430 is a circuit which detects zero crossing of the AC power supply 401, and outputs a ZEROX signal to a CPU 420. The ZEROX signal is used in control for the heater 300. The relay 440 is used as an energization interrupting unit (electric-power interrupting unit) for the heater 300, which operates (interrupts energization (power supply) to the heater 300) by an output sent from the thermistors TH1 to TH4, when the temperature of the heater 300 excessively rises because of failure and the like.

When an RLON 440 signal enters a High state, a transistor 443 enters an ON state, an electric current is passed to a secondary side coil of the relay 440 from a voltage Vcc2 of a power source, and a contact point in a primary side of the relay 440 enters an ON state. When the RLON 440 signal enters a Low state, the transistor 443 enters an OFF state, the electric current is interrupted, which flows from the voltage Vcc2 of a power source to the secondary side coil of the relay 440, and the contact point in the primary side of the relay 440 enters an OFF state. Incidentally, a resistance 444 is a current limiting resistance.

The operation of a safety circuit 455, which uses the relay 440, will be described below. When any one of temperatures (TH1 signal to TH4 signal) which have been detected by the thermistors TH1 to TH4 has exceeded the corresponding value in predetermined values that have been set respectively, a comparator 441 operates a latching device 442, and the latching device 442 latches the RLOFF signal in a Low state. When the RLOFF signal enters the Low state, the relay 440 is kept at the OFF state (safe state), because even though the CPU 420 sets the RLON 440 signal at the High state, the transistor 443 is kept at the OFF state. When the temperatures which have been detected by the thermistors TH1 to TH4 do not exceed the predetermined values that have been set respectively, the RLOFF signal of the latching device 442 enters an open state. Because of this, when the CPU 420 sets the RLON 440 signal at the High state, the relay 440 can be set at the ON state, and the heater 300 enters a state of being capable of being energized.

The operation of the triac 416 will be described below. Resistances 413 and 417 are bias resistances for the triac 416, and a phototriac coupler 415 is a device for securing a creepage distance between a primary side and a secondary side. When a light-emitting diode of the phototriac coupler 415 is energized, the triac 416 is thereby turned on. A resistance 418 is a resistance for limiting an electric current which flows from the power source voltage Vcc to the light-emitting diode of the phototriac coupler 415, and a transistor 419 turns on/off the phototriac coupler 415. The transistor 419 operates according to a FUSER1 signal which is sent from the CPU 420 through the current limiting resistance 412. In addition, a transistor 432 operates according to a relay driving signal which is sent from the CPU 420 through a current limiting resistance 435, and controls the driving of a magnet coil of a switching relay 431. When the triac 416 enters an energized state, an electric current is passed to any one of the heat generation block 302*a*-2 and the heat generation block 302*b*-2 according to the state of the switching relay 431.

A circuit operation of the triac 426 is similar to the triac 416, and accordingly the description will be omitted. Specifically, resistances 423 and 427 are provided as a similar structure to the resistances 413 and 417, and a phototriac coupler 425 is provided as a similar structure to the phototriac coupler 415. In addition, resistances 422, 428 and 436 are provided as a similar structure to the resistances 412, 418 and 435, and transistors 429 and 434 are provided as a similar structure to the transistors 419 and 432. The triac 426 operates according to a FUSER2 signal sent from a CPU 420. When the triac 426 enters an energized state, the triac 426 energizes and makes any of the heat generation block 302*a*-1 and the heat generation block 302*a*-3 or the heat generation block 302*b*-1 and the heat generation block 302*b*-3 generate heat, according to a state of the switching relay 433. In the case of the present embodiment, the heat generation block 302*a*-1 and the heat generation block 302*a*-3, and the heat generation block 302*b*-1 and the heat generation block 302*b*-3 are connected in parallel with each other, respectively, and accordingly an electric current is passed to the heat generation block having a combined resistance value of 35Ω.

A method for controlling a temperature of the heater 300 will be described below. A temperature which is detected by the thermistor TH1 is detected in a form of a divided voltage with an illustrated resistance as a TH1 signal, by the CPU 420 (where temperatures between thermistor TH2 to thermistor TH4 are detected by CPU 420 in similar method). The CPU (control unit) 420, converts the detected temperature of the thermistor TH1 into a control level of a wave number (wave number control), for instance, by PI control or the like, based on the detected temperature and the set temperature of the heater 300, in the internal processing, and controls the triac 416 and the triac 426 according to the control condition. In the present embodiment, the temperature of the heater 300 is controlled, based on the heater temperature which has been detected by the thermistor TH1, but the temperature control method is not limited to the method. For instance, it is also acceptable to detect the temperature of the film 202 by a thermistor or a thermopile, and to control the temperature of the heater 300, based on this detection temperature.

5. Heating Operation of Fixing Apparatus

Figure 5:
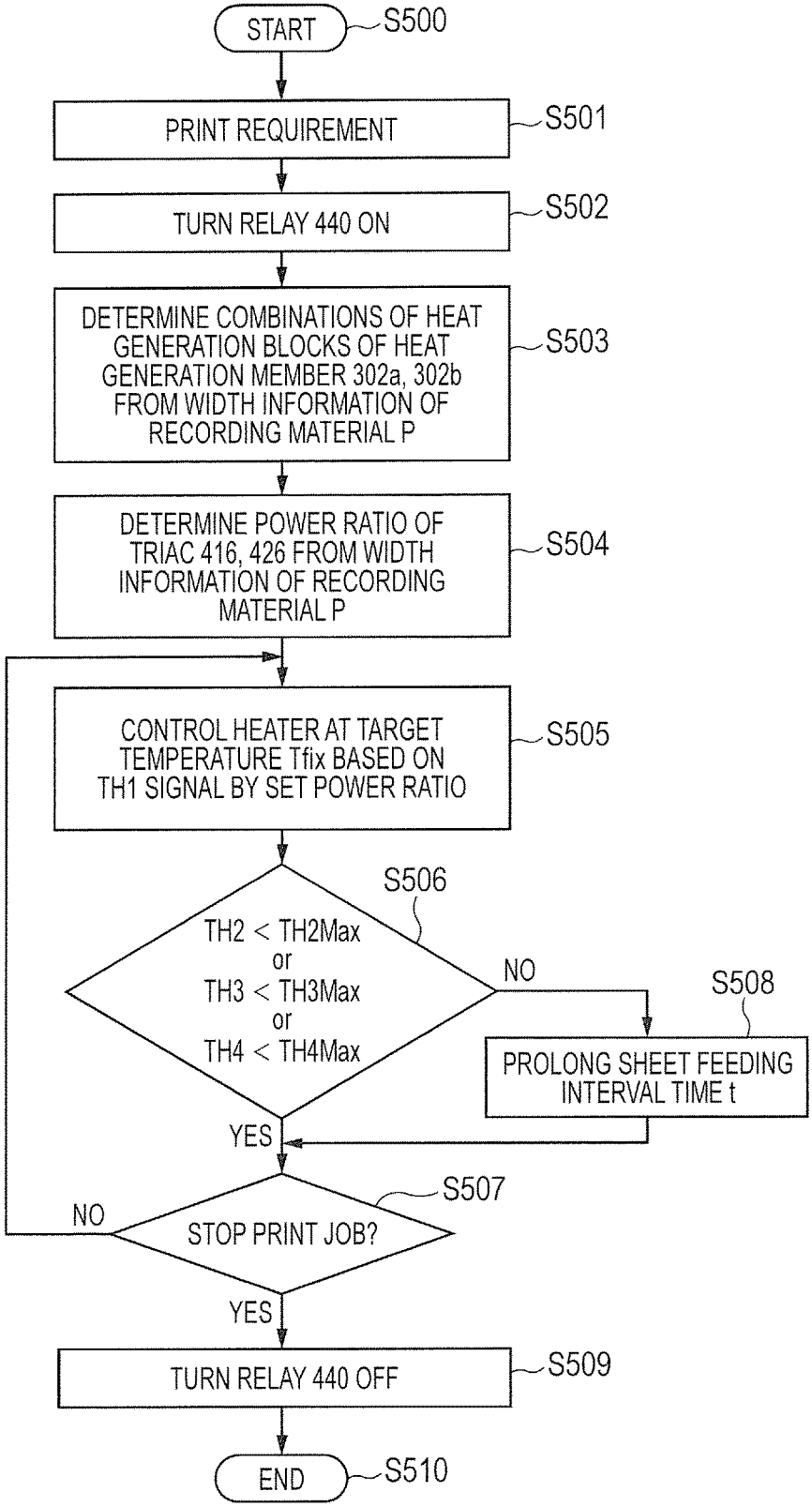
FIG. 5 is a flow chart of the heater control in Embodiment 1.

FIG. 5 is a flow chart that describes a control sequence of the apparatus 200, which is performed by the CPU 420. When a print requirement occurs in S501, the relay 440 is put in an ON state in S502. In the S503, the CPU switches the switching relays 431 and 433 according to the width information of the recording material P, and selects the heat generation blocks to be connected to each other, in each of the center heat generation block and the end heat generation blocks (heat generation block in line L1 or heat generation block in line L2). Table 1 shows the connection combinations of each of the heat generation blocks according to the widths of the recording materials P.

TABLE 1

| Width of recording material P | Center heat generation block | End portion heat generation block | Example of regular size paper |
|---|---|---|---|
| Equal to 190 mm or more | 302b-2 | 302b-1<br>302b-3 | LETTER, LEGAL, A4 |
| Equal to 160 mm or more and less than 190 mm | 302b-2 | 302a-1<br>302a-3 | EXECUTIVE, B5, C5 Envelope |
| Equal to 120 mm or more and less than 160 mm | 302b-2 | Arbitrary | A5 |
| Less than 120 mm | 302a-2 | Arbitrary | DL Envelope 3 inch × 5 inch |

As is illustrated in Table 1, when the width of the recording material P is equal to 190 mm or more, the blocks are connected that have the combination of the heat generation block 302*b*-2 for the center heat generation block and the heat generation blocks 302*b*-1 and 302*b*-3 for the end heat generation blocks. When the width of the recording material P is equal to 160 mm or more and less than 190 mm, the blocks are connected that have the combination of the heat generation block 302*b*-2 for the center heat generation block and the heat generation blocks 302*a*-1 and 302*a*-3 for the end heat generation blocks. When the width of the recording material P is equal to 120 mm or more and less than 160 mm, the blocks are connected that have arbitrary combinations of the heat generation block 302*b*-2 for the center heat generation block, and any one of the heat generation blocks 302*a*-1 and 302*a*-3 and the heat generation blocks 302*b*-1 and 302*b*-3 for the end heat generation blocks. When the width of the recording material P is less than 120 mm, the blocks are connected that have arbitrary combinations of the heat generation block 302*a*-2 for the center heat generation block, and any one of the heat generation blocks 302*a*-1 and 302*a*-3 and the heat generation blocks 302*b*-1 and 302*b*-3 for the end heat generation blocks.

In S504, power ratios of the triac 416 and the triac 426 are determined according to the width information of the recording material P. Table 2 shows the power ratios of the triac 416 and the triac 426 according to the widths of the recording materials P and the combinations of the heat generation blocks which generate heat by being energized.

TABLE 2

| Width of recording material P | Triac 416 (center) | Triac 426 (end portion) | Center heat generation block | End portion heat generation block | Example of regular size paper |
|---|---|---|---|---|---|
| Equal to 190 mm or more | 100 | 100 | 302b-2 | 302b-1<br>302b-3 | LETTER, LEGAL, A4 |
| Equal to 160 mm or more and less than 190 mm | 100 | 100 | 302b-2 | 302a-1<br>302a-3 | EXECUTIVE, B5, C5 Envelope |
| Equal to 120 mm or more and less than 160 mm | 100 | 0 | 302b-2 | — | A5 |
| Less than 120 mm | 100 | 0 | 302a-2 | — | DL Envelope 3 inch × 5 inch |

As is shown in Table 2, when the width of the recording material P is equal to 160 mm or more, the power ratio of the triac 416 and the triac 426 becomes 100:100, and when the width of the recording material P is less than 160 mm, the power ratio of the triac 416 and the triac 426 becomes 100:0.

Incidentally, a method for determining the width of the recording material P includes: a method of determining the width by providing an unillustrated paper width sensor on the paper-feeding cassette 11 and the paper-feeding tray 28; and a method of determining the width by using an unillustrated sensor such as a flag, which is provided on the conveyance path of the recording material P. In addition, a method is also acceptable that determines the width of the recording material P, based on the width information of the recording material P which a user has set, and on image information for forming an image on the recording material P. In addition, in the present embodiment, a heat generation block that generates heat is selected among the plurality of heat generation blocks of the heater 300, based on the width of the recording material P which is to have an image formed thereon, but the selection method is not limited to the method. For instance, it is also acceptable to select the heat generation block that is made to generate heat among the plurality of heat generation blocks of the heater 300, according to the width in which the image is formed, based on image information for forming the image on the recording material P.

In S505, fixing treatment is performed at a set target temperature Tfix of the thermistor TH1 with the use of the set power ratio.

In S506, the CPU determines whether the temperature exceeds each of the maximum temperature TH2Max of the thermistor TH2, the maximum temperature TH3Max of the thermistor TH3, and the maximum temperature TH4Max of the thermistor TH4 which have been set in the CPU 420. When the CPU has detected that the temperature of the paper non-passing part has risen and the temperature of the end portion in a heat generation region has exceeded a predetermined upper limit value, based on the thermistor signals TH2 to TH4, the process moves to S508, and alleviates the temperature rise at the paper non-passing part by extending a paper-feeding interval of the recording material P just by a time period t from next feeding. When the temperature of each of the thermistors does not exceed the maximum temperature in the S506, the process moves to S507. In the S507, the process moves to the S505 and the fixing treatment is continued until a print JOB ends.

The above described processes are repeated, and when the CPU has detected the end of the print JOB in the S507, turns the relay 440 OFF in S509, and ends the control sequence of the image formation in S510.

The heat generation distributions in the longitudinal direction according to the widths of the recording materials P are illustrated in FIGS. 6A to 6D.

Figure 6A:
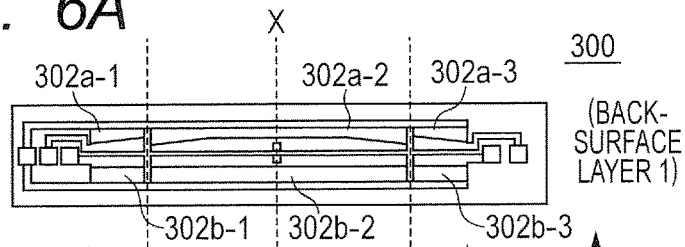
FIGS. 6A, 6B, 6C and 6D are views illustrating a heat generation distribution of a heater in Embodiment 1.
Figure 6A:
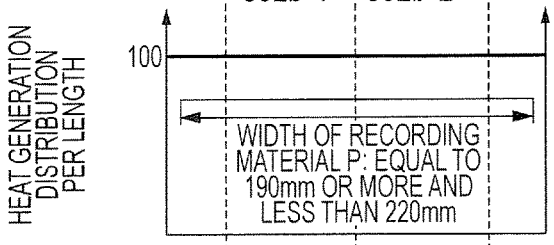
Figure 6E:
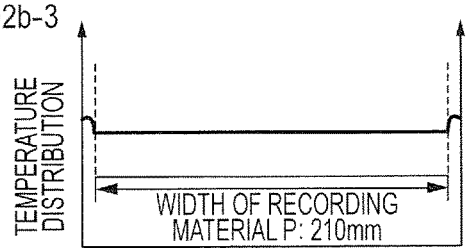
FIGS. 6E, 6F, 6G and 6H are views illustrating a temperature distribution of a film at the time when paper has been continuously fed.

As is illustrated in FIG. 6A, when the width of the recording material P is equal to 190 mm or more, the heat generation distribution becomes flat over the whole region in the longitudinal direction.

Figure 6B:
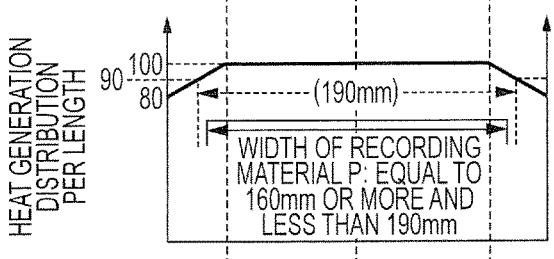
Figure 6F:
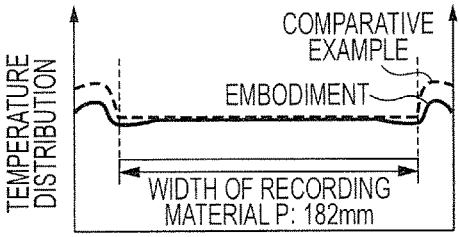

As is illustrated in FIG. 6B, when the width of the recording material P is equal to 160 mm or more and less than 190 mm, in the heat generation distribution, a heating value decreases from a part of the paper-feeding region to the paper non-passing region of the recording material P. In the present embodiment, the heat generation distribution is controlled so as to be capable of satisfying the fixing properties when the heating value per unit length in the end portion of the recording material P is equal to 90% or more of the heating value per unit length in the middle in the longitudinal direction, and accordingly the fixing properties of the recording material P can be satisfied by the above described heat generation distribution.

Figure 6C:
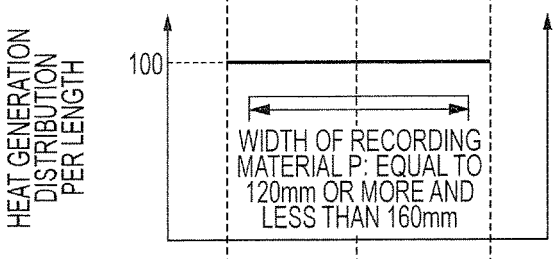
Figure 6G:
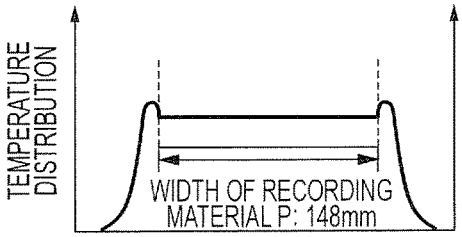

As is illustrated in FIG. 6C, when the width of the recording material P is equal to 120 mm or more and less than 160 mm, the heat generation blocks do not generate heat, which have been formed in the ranges of the end portions in the longitudinal direction, and only the heat generation block generates heat flatly, which has been formed in the range of the middle in the longitudinal direction. In order to satisfy the fixing properties of the recording material P having this width, the heat generation blocks in the end portions do not need to generate heat.

Figure 6D:
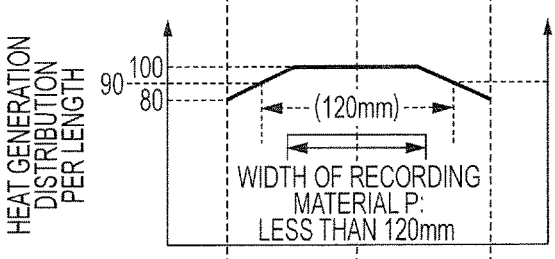
Figure 6H:
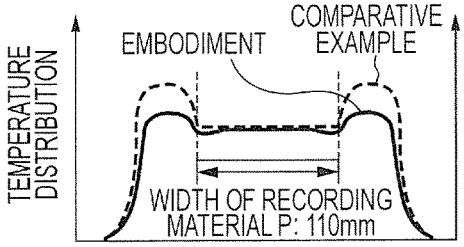

As is illustrated in FIG. 6D, when the width of the recording material P is less than 120 mm, the heat generation blocks do not generate heat, which have been formed in ranges of the end portions in the longitudinal direction, and besides, in the range in which the heat generation block is formed in the middle in the longitudinal direction, the heating value becomes small from a part of the paper passing region of the recording material P to the paper non-passing region. As has been described above, when the heating value per unit length in the end portion of the recording material P is equal to 90% or more of the heating value per unit length in the middle in the longitudinal direction, the fixing properties can be satisfied, and accordingly the above described heat generation distribution can satisfy the fixing properties of the recording material P.

FIGS. 6A to 6D illustrate the temperature distributions of the surface temperatures of the film 202 in the longitudinal direction, in the case where the recording materials P of each size have been each continuously fed.

FIG. 6A illustrates the temperature distribution at the time when A4 sheets (width of 210 mm) have been continuously fed which are representative regular size paper. The length of the heat generation member in the paper non-passing region is as short as 5 mm in one side, and accordingly a difference between temperatures of the paper passing region and the paper non-passing region is small.

FIG. 6B illustrates the temperature distribution at the time when JIS B5 sheets (width of 182 mm) have been continuously fed which are representative regular size paper. The length of the heat generation member in the paper non-passing region is 19 mm in one side, which is longer than that in the case of the above described A4 sheet, but the difference between temperatures of the paper passing region and the paper non-passing region is small. This is because the heating value in the paper non-passing region is controlled to be approximately 80% to 90% of that in the middle in the longitudinal direction, and the temperature in the paper non-passing region can be controlled to be low, compared to the case of a comparative example, where the heating value in the paper non-passing region is 100% which is the same as that in the middle in the longitudinal direction.

FIG. 6C illustrates a temperature distribution at the time when A5 sheets (width of 148 mm) have been continuously fed which are representative regular size paper. The length of the heat generation member in the paper non-passing region is as short as 6 mm in one side, and accordingly a difference between temperatures of the paper passing region and the paper non-passing region is small.

FIG. 6D illustrates the temperature distribution at the time when DL envelopes (width of 110 mm) have been continuously fed which are representative regular size paper. The length of the heat generation member in the paper non-passing region is 25 mm in one side, which is longer than that in the case of the above described A5 sheet, but the difference between temperatures of the paper passing region and the paper non-passing region is small. This is because the heating value in the paper non-passing region is controlled to be approximately 80% to 90% of that in the middle in the longitudinal direction, and the temperature in the paper non-passing region can be controlled to be low, compared to the case of a comparative example, where the heating value in the paper non-passing region is 100% which is the same as that in the middle in the longitudinal direction.

As has been described above, the heater in the present example has a structure in which each of the first and second heat generation lines L1 and L2 is divided in the longitudinal direction of the heater; and is not only structured so that each of the divided heat generation blocks can be independently controlled, but also is structured so that the first heat generation lines L1 and L2 can be independently controlled. In addition, the heat generation distributions are structured so as to be different between the heat generation blocks in the heat generation line L1 and the heat generation blocks in the heat generation line L2, respectively. By having such a structure, the heater can form the heat generation distributions equal to or more than the number of the divisions in the longitudinal direction of the heater. In addition, the number of the divisions in the longitudinal direction of the heater can be reduced, and accordingly there is a merit that the number of the electrodes on the substrate of the heater also can be reduced.

Incidentally, in the present embodiment, both of the heat generation members 302*a* and 302*b* have employed a material having the positive temperature characteristics of resistance, but the material is not limited to the above material. Even though a material having the negative temperature characteristics of resistance is used, or a material is used of which the temperature characteristics of resistance is 0, effects of the present invention are obtained.

Furthermore, in the present embodiment, when the width of the recording material P is less than 160 mm, the power ratios of the end heat generation blocks (302*a*-1 and 302*a*-3 or 302*b*-1 and 302*b*-3) have been set at 0, but are not limited to 0. For instance, in the cases where the fixing apparatus is warmed up and there is an excessive temperature difference in the longitudinal direction, or the like, the end heat generation blocks may be energized and heated, as needed.

Embodiment 2

In Embodiment 2, the heater control circuit is different from that in Embodiment 1. A control circuit 700 of the heater in the present embodiment is different from that in Embodiment 1 only in a point that the control circuit 700 has such a circuit configuration as to be capable of independently controlling each of the heat generation blocks (heat generation blocks 302*a*-1 to 302*a*-3 and heat generation blocks 302*b*-1 to 302*b*-3) of the heater 300 in Embodiment 1. In Embodiment 2, the elements that have functions and structures which are the same as or correspond to those in Embodiment 1 are designated by the same reference numerals, and the detailed description will be omitted. The matters which are not described here in Embodiment 2 are similar to those in Embodiment 1.

Figure 7:
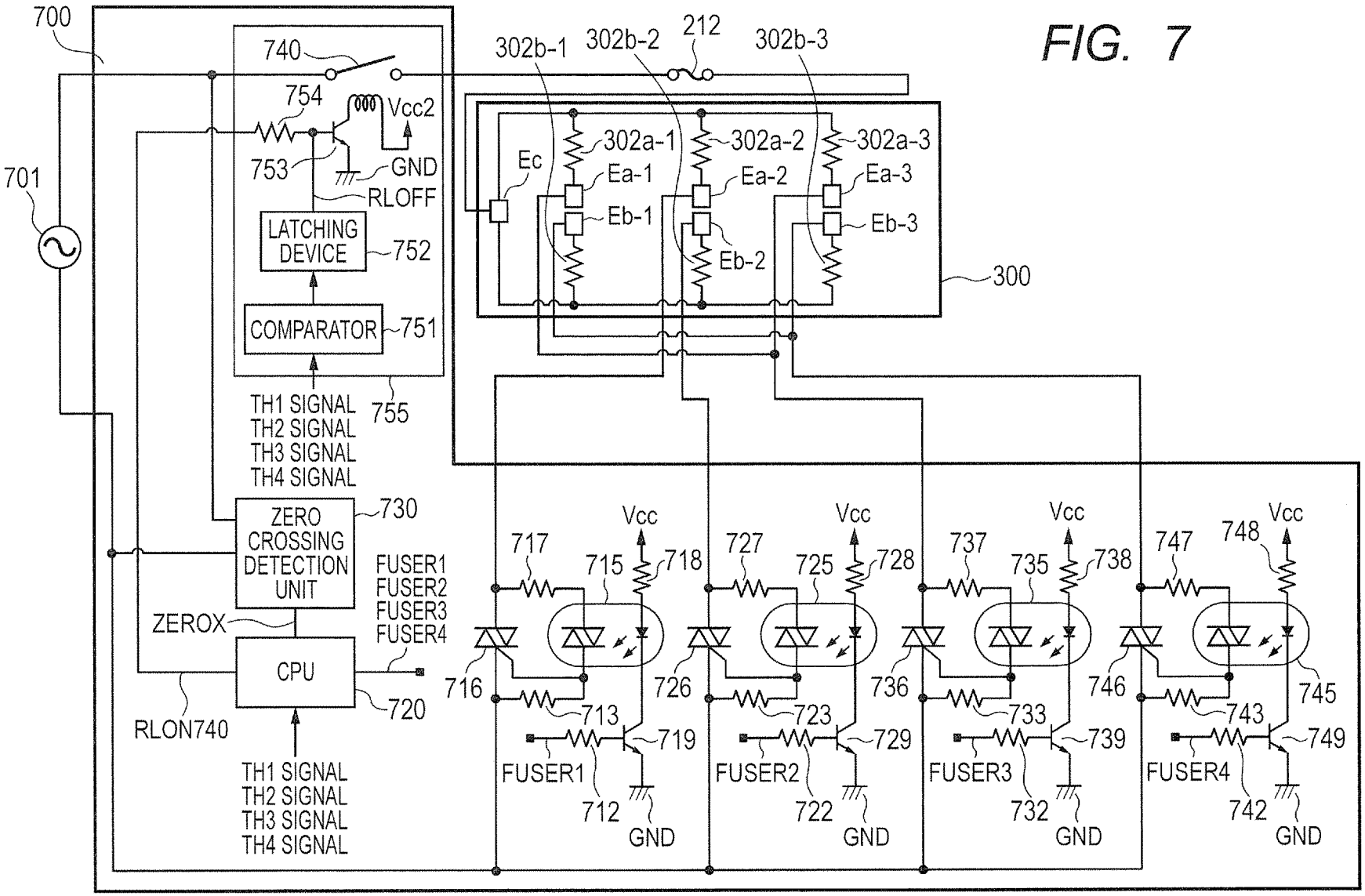
FIG. 7 is a diagram of a heater control circuit in Embodiment 2.

FIG. 7 illustrates a circuit diagram of the control circuit 700 of the heater 300 in the present embodiment. A commercial AC power supply 701 is connected to the image forming apparatus 100. Energization of the heater 300 is controlled by the energization/interruption of triacs 716, 726, 736 and 746. The triacs 716, 726, 736 and 746 operate according to a FUSER1 signal, a FUSER2 signal, a FUSER3 signal and a FUSER4 signal, respectively. In addition, the methods for controlling the temperatures of the safety circuit 755 and the heater 300 are similar to those in Embodiment 1.

The heat generation block 302*a*-2 in the center heat generation block is arranged on a conducting wire of the triac 716. Resistances 713 and 717 are bias resistances for the triac 716, and a phototriac coupler 715 is a device for securing a creepage distance between a primary side and a secondary side. When a light-emitting diode of the phototriac coupler 715 is energized, the triac 716 is thereby turned on. A resistance 718 is a resistance for limiting an electric current which flows from the power source voltage Vcc to the light-emitting diode of the phototriac coupler 715, and a transistor 719 turns on/off the phototriac coupler 715. The transistor 719 operates according to the FUSER1 signal that is sent from a CPU 720 through the current limiting resistance 712.

The heat generation block 302*b*-2 in the center heat generation block is arranged on a conducting wire of the triac 726. The circuit operation of the triac 726 is similar to that of the triac 716. Specifically, resistances 723 and 727 are provided as a similar structure to the resistances 713 and 717, and a phototriac coupler 725 is provided as a similar structure to the phototriac coupler 715. In addition, resistances 722 and 728 are provided as a similar structure to the resistances 712 and 718, and a transistor 729 is provided as a similar structure to the transistor 719. The triac 726 operates according to the FUSER2 signal sent from the CPU 720.

The heat generation blocks 302*a*-1 and 302*a*-3 in the end heat generation blocks are arranged on a conducting wire of the triac 736. The circuit operation of the triac 736 is similar to that of the triac 716. Specifically, resistances 733 and 737 are provided as a similar structure to the resistances 713 and 717, and a phototriac coupler 735 is provided as a similar structure to the phototriac coupler 715. In addition, resistances 732 and 738 are provided as a similar structure to the resistances 712 and 718, and a transistor 739 is provided as a similar structure to the transistor 719. The triac 736 operates according to the FUSER3 signal sent from the CPU 720.

The heat generation blocks 302*b*-1 and 302*b*-3 are arranged on a conducting wire of the triac 746. The circuit operation of triac 746 is similar to that of the triac 716. Specifically, resistances 743 and 747 are provided as a similar structure to the resistances 713 and 717, and a phototriac coupler 745 is provided as a similar structure to the phototriac coupler 715. In addition, resistances 742 and 748 are provided as a similar structure to the resistances 712 and 718, and a transistor 749 is provided as a similar structure to the transistor 719. The triac 746 operates according to the FUSER4 signal sent from the CPU 720.

The triacs 716, 726, 736 and 746 are independently controlled, and thereby the respectively corresponding heat generation blocks can be independently controlled. Incidentally, the heater control circuit 700 in the present embodiment has a zero crossing detection unit 730 as a similar structure to the zero crossing detection unit 430 of the heater control circuit 400 in Embodiment 1, and has a safety circuit 755 as a similar structure to the safety circuit 455. The other detailed structures and operations in the heater control circuit 700 in the present embodiment are different from those in the heater control circuit 400 only in a point that reference numerals of each of the structures have been changed to No. 700s from No. 400s in Embodiment 1, and are similar to those in the heater control circuit 400 in Embodiment 1; and the detailed description will be omitted.

The heater 300 is energized through the electrodes Ea-1 to Ea-3 and the electrodes Eb-1 to Eb-3, and the electrode Ec. In the present embodiment, the resistance values of the heat generation blocks 302*a*-1 and 302*b*-1 have been set at 140Ω, the resistance values of the heat generation blocks 302*a*-2 and 302*b*-2 have been set at 28Ω, and the resistance values of the heat generation blocks 302*a*-3 and 302*b*-3 have been set at 140Ω.

Figure 8:
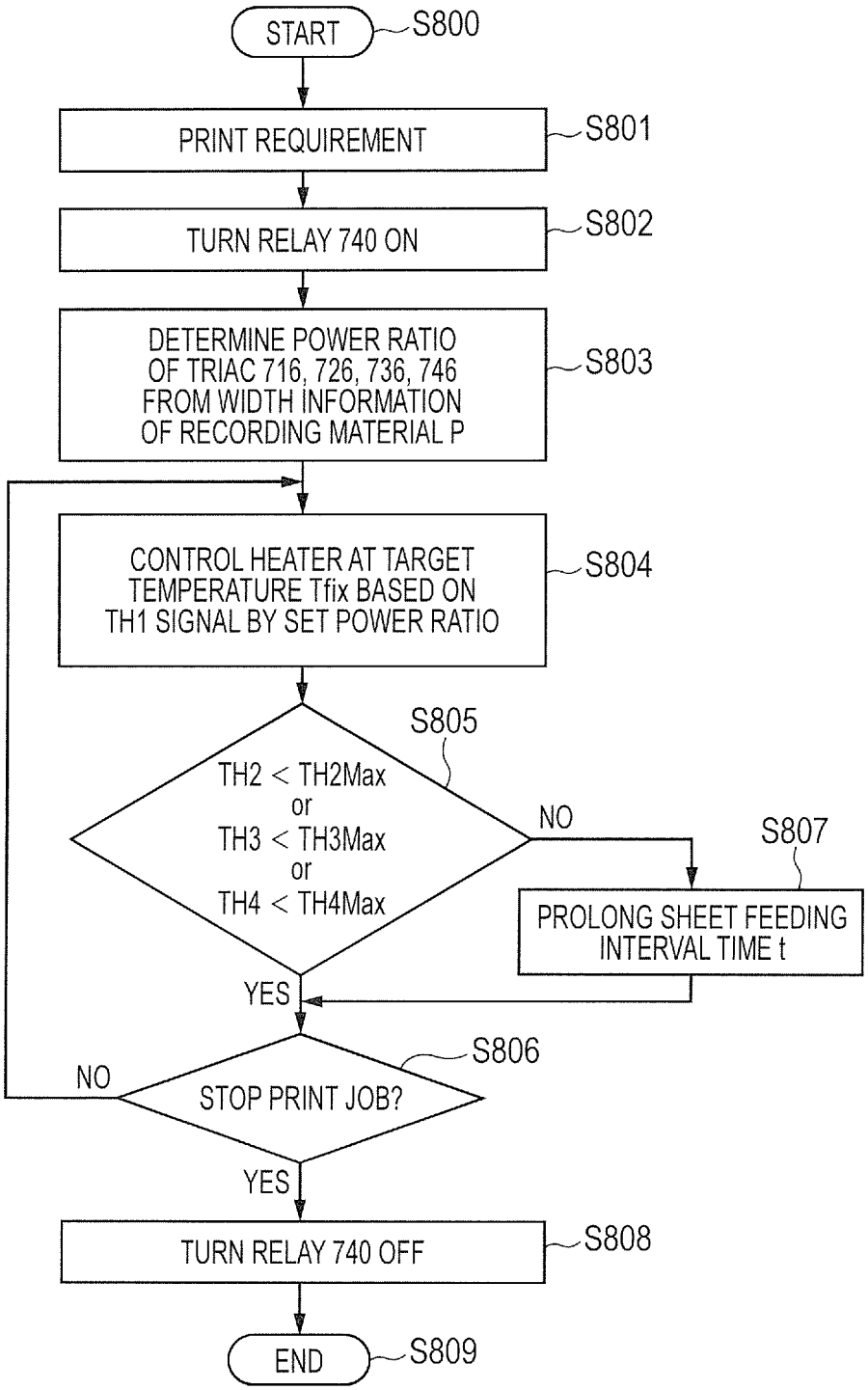
FIG. 8 is a flow chart of the heater control in Embodiment 2.

FIG. 8 is a flow chart that describes a control sequence of the image heating apparatus 200, which is performed by the CPU 720. When a print requirement occurs in S801, a relay 740 is put in an ON state in S802. In S803, power ratios of the triacs 716, 726, 736 and 746 are determined according to the width information of the recording material P. Table 3 shows power ratios of the triacs 716, 726, 736 and 746 according to the widths of the recording materials P.

TABLE 3

| Width of recording material P | Triac 716 (302a-2) | Triac 726 (302b-2) | Triac 736 (302a-1, 3) | Triac 746 (302b-1, 3) | Example of regular size paper |
|---|---|---|---|---|---|
| Equal to 205 mm or more | 0 | 100 | 0 | 100 | LETTER, LEGAL, A4 |
| Equal to 190 mm or more and less than 205 mm | 0 | 100 | 100 | 100 | 16K |
| Equal to 160 mm or more and less than 190 mm | 0 | 100 | 100 | 0 | EXECUTIVE, B5, C5 Envelope |
| Equal to 140 mm or more and less than 160 mm | 0 | 100 | 0 | 0 | A5 |
| Equal to 120 mm or more and less than 140 mm | 100 | 100 | 0 | 0 | |
| Less than 120 mm | 100 | 0 | 0 | 0 | DL Envelope 3 inch × 5 inch |

As is shown in Table 3, when the width of the recording material P is equal to 160 mm or more, the power ratio of the triac 716 and the triac 726 that are connected to the center heat generation block becomes 0:100. The power ratio of the triac 736 and the triac 746 for the end heat generation blocks becomes 0:100 when the width of the recording material P is equal to 205 mm or more, becomes 100:100 when the width of the recording material P is equal to 190 mm or more and less than 205 mm, and becomes 100:0 when the width of the recording material P is equal to 160 mm or more and less than 190 mm.

In addition, when the width of the recording material P is less than 160 mm, the power ratios of the triac 736 and the triac 746 are both 0, which are connected to the end heat generation blocks. The power ratio of the triac 716 and the triac 726 for the center heat generation block becomes 0:100 when the width of the recording material P is equal to 140 mm or more and less than 160 mm, becomes 100:100 when the width of the recording material P is equal to 120 mm or more and less than 140 mm, and becomes 100:0 when the width of the recording material P is less than 120 mm.

The subsequent steps after the S804 are similar to those after the S505 in Embodiment 1, and accordingly the description will be omitted.

When the power ratios are set at the power ratios shown in Table 3, the heating values per unit length in the end portion of the recording material P can be thereby secured to be equal to 90% or more of the heating value in the middle in the longitudinal direction, similarly to Embodiment 1, and accordingly the fixing properties can be satisfied. In addition to the above description, the temperature rise in the paper non-passing part can be efficiently controlled in ranges of recording materials having more various sizes than those in Embodiment 1. This is because the power ratios of the first and second heat generation blocks are determined for each of the center heat generation block and the end heat generation blocks of the heater 300, and are combined with each other, and thereby various variations can be selected for the heat generation distributions in the longitudinal direction of the heater 300.

The heater control circuit 700 in the present embodiment that has been described above also can suppress the temperature rise in the paper non-passing part for various sizes without increasing the number of divisions for the heat generation block in the longitudinal direction, and accordingly a heater and an image heating apparatus can be provided that are advantageous to reduce power requirements.

Embodiment 3

Embodiment 3 of the present invention will be described below. The basic structure and operation of an image forming apparatus in Embodiment 3 are the same as those in Embodiments 1 and 2. Accordingly, the elements that have functions and structures which are the same as or correspond to those in Embodiments 1 and 2 are designated by the same reference numerals, and the detailed description will be omitted. The matters which are not described here in Embodiment 3 are similar to those in Embodiments 1 and 2. In the present embodiment, the structure of the heater is different from those in Embodiments 1 and 2.

Figure 9:
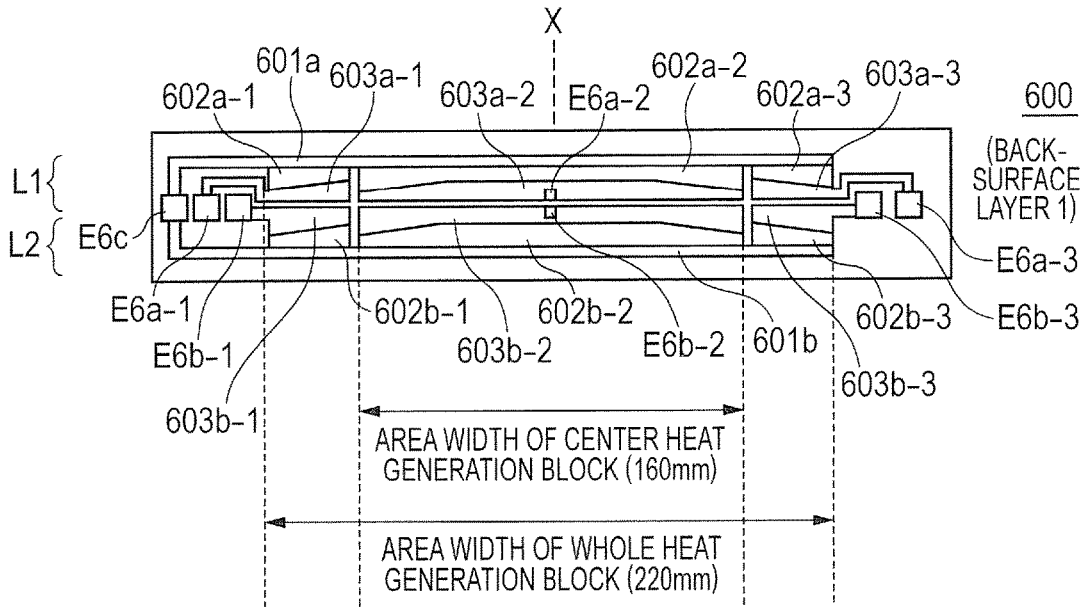
FIG. 9 is a block diagram of a heater in Embodiment 3.

The structure of a heater 600 in the present embodiment will be described in detail below with reference to FIG. 9. The heater 600 in the present embodiment has each of the heat generation blocks (heat generation blocks 602*a*-1 to 602*a*-3, and heat generation blocks 602*b*-1 and 602*b*-3) which are blocks divided into three in the longitudinal direction of the heater. The heat generation blocks 602*a*-1 to 602*a*-3 (first heat generation line L1) are structured so that the heating value increases as the position becomes closer to the reference X and decreases as the position becomes closer to the end portions in the longitudinal direction of the heater, in each of the heat generation blocks. This structure shall be referred to as a high-in-middle tapered heat generation member. On the other hand, the heat generation blocks 602*b*-1 to 602*b*-3 (heat generation line L2) are structured so that the heating value decreases as the position becomes closer to the reference X and increases as the position becomes closer to the end portions in the longitudinal direction of the heater, in each of the heat generation blocks. This structure shall be referred to as a high-in-end tapered heat generation member. These points are different from those in Embodiments 1 and 2.

The back-surface layer 1 that is provided on the substrate 605 has a conductive member 601*a* and a conductive member 601*b* which act as a conductive member A that is provided along the longitudinal direction of the heater 600. The conductive member 601*a* is arranged in the upstream side in the conveyance direction of the recording material P, and the conductive member 601*b* is arranged in the downstream side in the conveyance direction of the recording material P. In addition, the back-surface layer 1 has a conductive member 603*a* (603*a*-1 to 603*a*-3) and a conductive member 603*b* (603*b*-1 to 603*b*-3) that act as a conductive member B which is provided in parallel with the conductive member 601. The conductive member B is provided along the longitudinal direction of the heater 600 at a position different from that of the conductive member A in a transverse direction of the heater 600.

Furthermore, the back-surface layer 1 has heat generation blocks 602*a*-1 to 602*a*-3 that constitute the heat generation block which has the heat generation member 602*a* provided between the conductive member 601*a* and the conductive member 603*a*, and that constitute a first heat generation block group (first heat generation line L1). In addition, the back-surface layer 1 has heat generation blocks 602*b*-1 to 602*b*-3 that constitute the heat generation block which has the heat generation member 602*b* provided between the conductive member 601*b* and the conductive member 603*b*, and that constitute a second heat generation block group (second heat generation line L2). As for the arrangement of the heat generation member 602*a*, the heat generation member 602*a* that is the high-in-middle tapered heat generation member as will be described later is a main heat generation member which has a larger heating value than that of the heat generation member 602*b* that is the high-in-end tapered heat generation member, and which generates heat by being energized even when the width of the recording material P is any width. Because of this, the heat generation member 602*a* is arranged in a more upstream side in the conveyance direction of the recording material P than the heat generation member 602*b*, so as to enhance an efficiency of transferring heat to the recording material P.

The heat generation blocks 602*a*-1 to 602*a*-3 that constitute the first heat generation line L1 generate heat by being energized through the conductive members 603*a*-1 to 603*a*-3 which are connected to electrodes E6*a*-1 to E6*a*-3, respectively, and the conductive member 601*a* which is connected to an electrode E6*c*.

In the present embodiment, the heating values in the heat generation block 602*a*-1 and the heat generation block 602*a*-3 have been each adjusted so that when the heating value at the position which is closest to the reference X is specified as 100, the heating value at the position which is most distant from the reference X becomes 70. The resistance value distribution has been adjusted so that the heating value gradually decreases as the position becomes closer to the position which is most distant from the reference X, from the position which is closest to the reference X. In addition, the heating value in the heat generation block 602*a*-2 has been adjusted so that when the heating value at the position of the reference X is specified as 100, the heating value in spaces between the position of the reference X and positions 40 mm distant from the reference X becomes 100, and the heating value at the position which is the extreme end portion of the heat generation block 602*a*-2 becomes 60. Specifically, in the heat generation block 602*a*-2, there is a region of 80 mm, in which the heating value is flat, in the middle of the block in the longitudinal direction, and the resistance value distribution has been adjusted so that the heating value gradually decreases as the position becomes closer to the end portion from the region.

The heat generation blocks 602*b*-1 to 602*b*-3 that constitute the second heat generation line L2 generate heat by being energized through the conductive members 603*b*-1 to 603*b*-3 which are connected to the electrodes E6*b*-1 to E6*b*-3, respectively, and the conductive member 601*b* which is connected to the electrode E6*c*. In the present embodiment, in the heat generation blocks 602*b*-1 to 602*b*-3, the resistance value distributions in the heat generation blocks have been each adjusted so that the heating value at the position which is most distant from the reference X becomes largest, and the heating value decreases as the position becomes closer to the reference X.

The heating value of the heat generation member 602*b* in the present embodiment is adjusted so that the sum of the heating values at the time when the heat generation members 602*a* and 602*b* are energized at the same ratio becomes a flat distribution in the longitudinal direction. In other words, the heat generation members are formed so that the sum of the heating values of the heat generation member 602*a* and the heat generation member 602*b* becomes constant at an arbitrary position in the longitudinal direction within a range in which the heat generation members 602*a* and 602*b* are formed.

As for the resistance values of each of the heat generation blocks, the resistance value of the heat generation block 602*a*-1 has been set at 70Ω, the resistance value of the heat generation block 602*a*-2 has been set at 14Ω, and the resistance value of the heat generation block 602*a*-3 has been set at 70Ω. In addition, the resistance value of the heat generation block 602*b*-1 has been set at 140Ω, the resistance value of the heat generation block 602*b*-2 has been set at 28Ω, and the resistance value of the heat generation block 602*b*-3 has been set at 140Ω. In other words, the heating value of the high-in-middle tapered heat generation member 602*a* has been set so as to be larger than that of the high-in-end tapered heat generation member, when both of the heat generation members have been energized at the same power ratio.

The control circuit 700 in Embodiment 2 is used as a driving unit of the heater 600. Energization of the heater 600 is controlled by the energization/interruption of triacs 716, 726, 736 and 746. The heat generation block 602*a*-2 is arranged on a conducting wire of the triac 716, and the heat generation block 602*b*-2 is arranged on a conducting wire of the triac 726. In addition, the heat generation blocks 602*a*-1 and 602*a*-3 are arranged on a conducting wire of the triac 736, and the heat generation blocks 602*b*-1 and 602*b*-3 are arranged on a conducting wire of the triac 746. The triacs 716, 726, 736 and 746 are independently controlled, and thereby the respectively corresponding heat generation blocks can be independently controlled. The heater 600 is energized through the electrodes E6*a*-1 to E6*a*-3 and the electrodes E6*b*-1 to E6*b*-3, and the electrode E6*c*. The control sequence of the image heating apparatus 200 that mounts the heater 600 thereon is similar to the control sequence in Embodiment 2, and accordingly the description will be omitted, but the power ratios of the triacs 716, 726, 736 and 746 are set in Table 4.

TABLE 4

| Width of recording material P | Triac 716 (602a-2) | Triac 726 (602b-2) | Triac 736 (602a-1, 3) | Triac 746 (602b-1, 3) | Example of regular size paper |
|---|---|---|---|---|---|
| Equal to 200 mm or more | 100 | 100 | 100 | 100 | LETTER, LEGAL, A4 |

TABLE 4-continued

| Width of recording material P | Triac 716 (602a-2) | Triac 726 (602b-2) | Triac 736 (602a-1, 3) | Triac 746 (602b-1, 3) | Example of regular size paper |
|---|---|---|---|---|---|
| Equal to 180 mm or more and less than 200 mm | 100 | 100 | 100 | 50 | EXECUTIVE, B5 |
| Equal to 160 mm or more and less than 180 mm | 100 | 100 | 100 | 0 | C5 Envelope |
| Equal to 140 mm or more and less than 160 mm | 100 | 100 | 0 | 0 | A5 |
| Equal to 120 mm or more and less than 140 mm | 100 | 67 | 0 | 0 | |
| Equal to 100 mm or more and less than 120 mm | 100 | 50 | 0 | 0 | DL Envelope |
| Less than 100 mm | 100 | 0 | 0 | 0 | 3 inch × 5 inch |

According to Table 4, when the width of the recording material P is equal to 160 mm or more, the power ratio of the triac 716 and the triac 726 for the center heat generation blocks becomes 100:100. The power ratio of the triac 736 and the triac 746 for the end heat generation blocks becomes 100:100 when the width of the recording material P is equal to 200 mm or more, becomes 100:50 when the width of the recording material P is equal to 180 mm or more and less than 200 mm, and becomes 100:0 when the width of the recording material P is equal to 160 mm or more and less than 180 mm.

In addition, when the width of the recording material P is less than 160 mm, the power ratios of the triac 736 and the triac 746 for the end heat generation blocks are both 0. The power ratio of the triac 716 and the triac 726 for the center heat generation block becomes 100:100 when the width of the recording material P is equal to 140 mm or more and less than 160 mm, and becomes 100:67 when the width of the recording material P is equal to 120 mm or more and less than 140 mm. In addition, when the width of the recording material P is equal to 100 mm or more and less than 120 mm, the power ratio becomes 100:50, and when the width of the recording material P is less than 100 mm, the power ratio becomes 100:0.

When the power ratios are set at the power ratios shown in Table 4, the heating values in the end portions of the recording material P can be thereby secured to be equal to 90% or more of the heating value in the middle, similarly to Embodiment 1, and accordingly the fixing properties of the recording material P can be satisfied. In addition to the above description, the temperature rise in the paper non-passing part can be efficiently controlled in ranges of more various sizes than those in Embodiment 2. This is because the power ratios in the respective heat generation blocks are combined, with the use of the high-in-middle tapered heat generation member 602*a* and the high-in-end tapered heat generation member 602*b*, and thereby options for the heat generation distributions in the longitudinal direction can be increased.

As has been described above, a structure in the present embodiment has the heater 600 and the heater control circuit 700 in Embodiment 2 combined with each other, and is thereby becomes such a structure as to determine the power ratios of the first heat generation line L1 and the second heat generation line L2 according to the size of the recording material, and to generate heat by being energized. The structure according to the present embodiment can also suppress the temperature rise in the paper non-passing part for various sizes, without increasing the number of divisions in the longitudinal direction of the heat generation blocks, and accordingly can provide a heater and an image heating apparatus that are advantageous to reduce power requirements. In the present embodiment, an example has been described in which the circuit controls each of the heat generation blocks independently like the control circuit 700 as the driving unit of the heater 600, but the circuit is not limited to the example. The effect is obtained also, for instance, by a control of switching between each of the heat generation blocks with the use of the switching relay as is the control circuit 400 that has been described in Embodiment 1.

Embodiment 4

Embodiment 4 of the present invention is a modified example of the heater 600 of Embodiment 3. The heat generation distributions of the first heat generation line L1 and the second heat generation line L2 that are provided in the heater 900 in the present example are the same as those in Embodiment 3. In Embodiment 4, the elements that have functions and structures which are the same as or correspond to those in Embodiment 3 are designated by the same reference numerals, and the detailed description will be omitted. The matters which are not described here in Embodiment 4 are similar to those in Embodiment 3.

Figure 10:
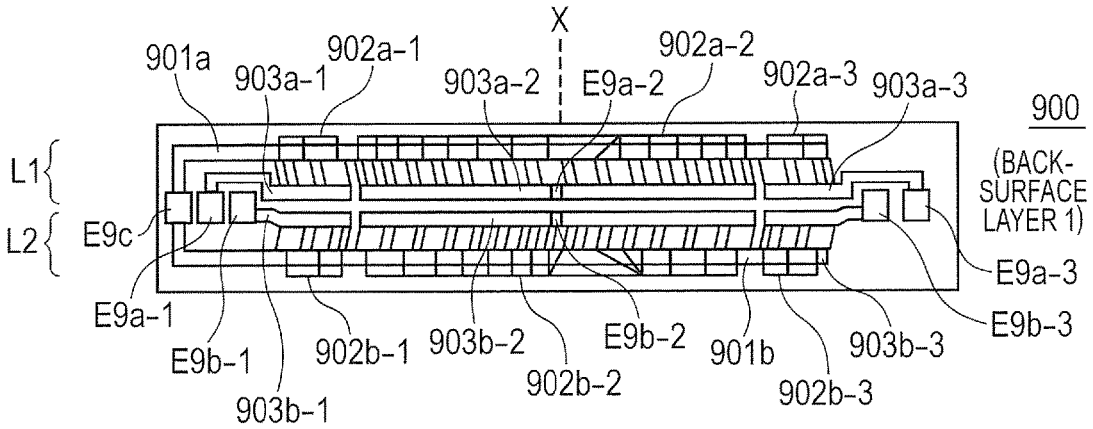
FIG. 10 is a block diagram of a heater in Embodiment 4.

FIG. 10 illustrates a plan view of a layer which has heat generation members of the heater 900 in the present embodiment formed thereon. The heater 900 in the present embodiment has a pair of heat generation blocks which are each divided into three in the longitudinal direction of the heater. The pair of each heat generation block is formed of two heat generation blocks that are aligned in a transverse direction. Specifically, the pair is formed of heat generation blocks 902*a*-1 to 902*a*-3 that constitute a first heat generation block group (first heat generation line L1), and heat generation blocks 902*b*-1 to 902*b*-3 that constitute a second heat generation block group (second heat generation line L2). These heat generation block groups have features that the heat generation blocks have each different heat generation distribution in the longitudinal direction from others, and besides that the heat generation members 902*a* and 902*b* which are each a single heat generation member in Embodiment 3 are divided into a plurality of heat generation member patterns that are further connected in parallel in each of the heat generation blocks.

The heat generation block 902*a*-1 which has been divided into the plurality of heat generation member patterns is connected between a conductive member 903*a*-1 and a conductive member 901*a*, and is energized to generate heat. The heat generation block 902*b*-1, the heat generation block 902*a*-2, the heat generation block 902*b*-2, the heat generation block 902*a*-3 and the heat generation block 902*b*-3 also have similar structures to that of the heat generation member 902*a*-1. The plurality of heat generation member patterns which are connected in parallel in the heat generation block 902*a*-1 are structured so as to be arranged while being tilted with respect to the longitudinal direction and the transverse direction of the heater 900. Specifically, the length (width) of the heat generation member pattern in the longitudinal direction of the heater 900 is changed in the longitudinal direction of the heater 900, in a space between the conductive member 903*a*-1 and the conductive member 901*a*, and thereby the heat generation distributions are made to be different from each other. In the present embodiment, the width of the gaps between the plurality of heat generation member patterns which are connected in parallel in the heat generation members 902*a*-1 to 902*a*-3 and 902*b*-1 to 902*b*-3 have been set at the same width, and the widths of each of the heat generation member patterns in the longitudinal direction of the heater have been adjusted.

A method for adjusting the heating value per unit length in the longitudinal direction of the heater 900 is not limited to the above method, and the heating value can be adjusted by the length in the transverse direction, the width of the gap (gap between adjacent heat generation member patterns), the tilting angle, the thickness and the like, in the heaters of the respective heat generation member patterns. Furthermore, it is also possible to form the heat generation distributions by changing the material resistance values (volume resistivity) of the plurality of heat generation member patterns which are connected in parallel, respectively. A similar effect to that in Embodiment 3 can be obtained with the use of the heater 900 in the present embodiment.

Other Embodiments

In Embodiments 1 to 4, the structure examples of the heater have been described that is mounted on the image heating apparatus in which the paper passing reference X of the recording material P is the center reference. However, the present invention is not limited to the above structure example, and can also be applied to an image heating apparatus of so-called a one-side reference, in which the paper passing reference X is in the vicinity of the end portion in the longitudinal direction of the heater.

Figure 11:
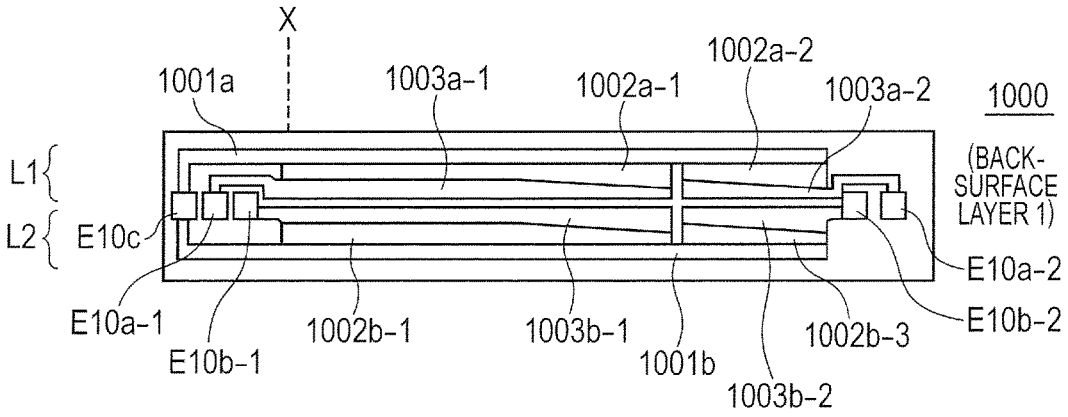
FIG. 11 is a block diagram of a heater in another embodiment.

FIG. 11 illustrates a structure example of a heater 1000 which is mounted on an image heating apparatus of the one-side reference. The heater 1000 is a modified example of the heater 600 in Embodiment 3. The heater 1000 has heat generation blocks 1002*a*-1 and 1002*a*-2 which constitute a first heat generation block group (first heat generation line L1), and heat generation blocks 1002*b*-1 and 1002*b*-2 which constitute a second heat generation block group (second heat generation line L2). The heat generation block 1002*a*-2 and the heat generation block 1002*a*-2 have such a structure that a heating value is largest at a position of the paper passing reference X, which is closer to one end portion in the longitudinal direction, and that the heating value decreases as the distance from the paper passing reference X increases. On the other hand, the heat generation block 1002*b*-1 and the heat generation block 1002*b*-2 have such a structure that the heating value is smallest at the position of the paper passing reference X, which is closer to the one end portion in the longitudinal direction, and that the heating value increases as the distance from the paper passing reference X increases. In addition, the electrodes (E10*c*, E10*a*-1, E10*a*-2, E10*b*-1 and E10*b*-2) for energizing each of the heat generation members therethrough are formed only on the end portion in the longitudinal direction of the heater 1000.

In FIG. 11, the modified example of the heater 600 in Embodiment 3 is illustrated, but a similar modified example can be applied also to any heater described in Embodiments 1 to 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-181134, filed Sep. 14, 2015, which is hereby incorporated by reference herein in its entirety.

What is claimed is:

1. A heater comprising:

a substrate;

a first heat generation line provided on the substrate along a longitudinal direction of the substrate, and divided into a plurality of heat generation blocks which are mutually independently controllable, in the longitudinal direction; and a second heat generation line provided on the substrate along the longitudinal direction of the substrate, and divided into a plurality of heat generation blocks which are mutually independently controllable, in the longitudinal direction, wherein in the plurality of heat generation blocks in the second heat generation line, a heat generation block is provided that overlaps one heat generation block in the first heat generation line in the longitudinal direction and has a different heat generation distribution in the longitudinal direction than the one heat generation block in the first heat generation line.

2. The heater according to claim 1, wherein in at least one of the first heat generation line and the second heat generation line, the plurality of heat generation blocks have such a structure that a heat generation member is connected between a pair of conductive members provided along the longitudinal direction, and an electric current flows in the heat generation member in a direction which intersects with the longitudinal direction.

3. The heater according to claim 1, wherein the heat generation block comprises a plurality of heat generation member patterns that are connected in parallel between a pair of conductive members.

4. An image heating apparatus for heat-fixing an image on a recording material, comprising:

a cylindrical film; and a heater including:

a substrate;

a first heat generation line provided on the substrate along a longitudinal direction of the substrate, and divided into a plurality of heat generation blocks which are mutually independently controllable, in the longitudinal direction; and a second heat generation line provided on the substrate along the longitudinal direction of the substrate, and divided into a plurality of heat generation blocks which are mutually independently controllable, in the longitudinal direction, wherein in the plurality of heat generation blocks in the second heat generation line, a heat generation block is provided that overlaps one heat generation block in the first heat generation line in the longitudinal direction and has a different heat generation distribution in the longitudinal direction than the one heat generation block in the first heat generation line, wherein the heater comes in contact with an inner surface of the cylindrical film, and wherein an image is fixed on a recording material by heat from the heater through the cylindrical film.

5. The image heating apparatus according to claim 4, further comprising a control unit which controls the heater, wherein the control unit sets a power ratio between the plurality of heat generation blocks of at least one of the first heat generation line and the second heat generation line, according to a size of the recording material.

6. The image heating apparatus according to claim 5, wherein the control unit sets the power ratio between the heat generation block in the first heat generation line and the heat generation block in the second heat generation line, which have such a relationship that the heat generation blocks overlap each other in the longitudinal direction and have the different heat generation distributions from each other in the longitudinal direction, according to the size of the recording material.

7. The image heating apparatus according to claim 4, wherein the plurality of the heat generation blocks in the first heat generation line and the plurality of the heat generation blocks in the second heat generation line are controlled for heat generating based on image information for forming the image on the recording material.

8. The image heating apparatus according to claim 4, wherein in at least one of the first heat generation line and the second heat generation line, the plurality of heat generation blocks have such a structure that a heat generation member is connected between a pair of conductive members provided along the longitudinal direction, and an electric current flows in the heat generation member in a direction which intersects with the longitudinal direction.

9. The image heating apparatus according to claim 4, wherein the heat generation block comprises a plurality of heat generation member patterns that are connected in parallel between a pair of conductive members.

10. The heater according to claim 1, wherein the one heat generation blocks in the first heat generation line and the heat generation block in the second heat generation line overlap with the one heat generation block are independently controllable each other.

11. The heater according to claim 4, wherein the one heat generation block in the first heat generation line and the heat generation block in the second heat generation line that overlaps with the one heat generation block in the first heat generation line are independently controllable each other.

12. The heater according to claim 1, wherein divided positions of the plurality of heat generation blocks in the first heat generation line and divided positions of the plurality of heat generation blocks in the second heat generation line are arranged at the same positions in the longitudinal direction.

13. The image heating apparatus according to claim 4, wherein divided positions of the plurality of heat generation blocks in the first heat generation line and divided positions of the plurality of heat generation blocks in the second heat generation line are arranged at the same positions in the longitudinal direction.

14. The heater according to claim 1, wherein in each of the plurality of heat generation blocks in the first heat generation line, a distribution of a resistance value in the longitudinal direction is such that a quantity of heat generation becomes largest in a region closer to a center of the substrate in the longitudinal direction and decreases as the distance from the center of the substrate in the longitudinal direction increases.

15. The image heating apparatus according to claim 4, wherein in each of the plurality of heat generation blocks in the first heat generation line, a distribution of a resistance value in the longitudinal direction is such that a quantity of heat generation becomes largest in a region closer to a center of the substrate in the longitudinal direction and decreases as the distance from the center of the substrate in the longitudinal direction increases.

16. The heater according to claim 14, wherein in each of the plurality of heat generation blocks in the second heat generation line, a distribution of a resistance value in the longitudinal direction is such that a quantity of heat generation becomes smallest in a region closer to a center of the substrate in the longitudinal direction and increases as the distance from the center of the substrate in the longitudinal direction increases.

17. The image heating apparatus according to claim 15, wherein in each of the plurality of heat generation blocks in the second heat generation line, a distribution of a resistance value in the longitudinal direction is such that a quantity of heat generation becomes smallest in a region closer to a center of the substrate in the longitudinal direction and increases as the distance from the center of the substrate in the longitudinal direction increases.

18. The image heating apparatus according to claim 17, wherein the first heat generation line is arranged upstream of the second heat generation line in a conveyance direction of the recording material.

* * * * *